US008025554B2

(12) United States Patent
Moriya

(10) Patent No.: US 8,025,554 B2
(45) Date of Patent: Sep. 27, 2011

(54) METHOD OF POLISHING WORK

(75) Inventor: Norihiko Moriya, Nagano (JP)

(73) Assignee: Fujikoshi Machinery Corp., Nagano (JP)

( * ) Notice: Subject to any disclaimer, the term of this patent is extended or adjusted under 35 U.S.C. 154(b) by 0 days.

(21) Appl. No.: 11/633,506

(22) Filed: Dec. 5, 2006

(65) Prior Publication Data

US 2007/0128985 A1 Jun. 7, 2007

(30) Foreign Application Priority Data

Dec. 6, 2005 (JP) ..... 2005-351510

(51) Int. Cl.
*B24B 49/00* (2006.01)

(52) U.S. Cl. ..... 451/8; 451/5; 451/9; 451/10; 451/11; 451/36; 451/41; 451/63; 451/261; 451/262

(58) Field of Classification Search ..... 451/5, 8, 451/9, 10, 11, 36, 41, 63, 259, 261, 262, 451/268, 285, 286, 287
See application file for complete search history.

(56) References Cited

U.S. PATENT DOCUMENTS 3,774,348 A * 11/1973 Dunn ..... 451/262
3,813,828 A * 6/1974 Bennett ..... 451/28
5,587,915 A * 12/1996 Nagatomi ..... 700/177
5,904,608 A * 5/1999 Watanabe ..... 451/5
6,062,949 A * 5/2000 Yashiki et al. ..... 451/10
6,416,617 B2 * 7/2002 Yoshida et al. ..... 156/345.13
6,612,908 B2 * 9/2003 Hori ..... 451/36
2004/0043713 A1 * 3/2004 Moriya et al. ..... 451/262
2006/0178089 A1 * 8/2006 Ueno ..... 451/41

FOREIGN PATENT DOCUMENTS

JP 05-123962 A 5/1993
JP 09-057612 A 3/1997

* cited by examiner

*Primary Examiner* — Robert Scruggs
(74) *Attorney, Agent, or Firm* — Birch, Stewart, Kolasch & Birch, LLP

(57) ABSTRACT

In the method of precisely polishing a work, torque of a sun gear and an internal gear are kept constant and a load applied to a carrier is reduced and maintained. The method comprises the steps of: changing a rotational speed of at least one of the sun gear, the internal gear, an upper polishing plate and a lower polishing plate; measuring rotation torque of a driving motor of at least one of the sun gear and the internal gear; detecting the minimum rotation torque measured in the measuring step; and adjusting the rotational speed of at least one of the sun gear, the internal gear, the upper polishing plate and the lower polishing plate so as to make the rotation torque thereof equal to the minimum rotation torque or running rotation torque, the running rotation torque being greater by a prescribed value than the minimum rotation torque.

8 Claims, 2 Drawing Sheets

METHOD OF POLISHING WORK

BACKGROUND OF THE INVENTION

The present invention relates to a method of polishing a work, more precisely relates to a method of polishing a work, which is capable of reducing load applied to a carrier and the work so as to precisely polish the work.

In a conventional apparatus for polishing both surfaces of a work, e.g., lapping apparatus, polishing apparatus, a work is held by a carrier, which engages with a sun gear and an internal gear and which is orbited around the sun gear. An upper polishing plate and a lower polishing plate, which are rotated in the opposite directions, respectively contact and polish both surfaces of the work. Abrading liquid (slurry) is fed while polishing the work. In a polishing apparatus, polishing pads are respectively adhered on polishing faces of upper and lower polishing plates. Note that, in the following description, the words "abrasion" and "lapping" fall into the concept of "polish".

In the conventional polishing apparatus, the upper polishing plate and the lower polishing plates are rotated in the opposite directions. Further, an orbital direction and a speed of the carrier is adjusted so as to make a frictional force between the upper polishing plate and an upper face of the carrier and a frictional force between the lower polishing plate and a lower face of the carrier equal and orient in the opposite directions. However, the carrier is orbited and rotated, so influence of the rotation cannot be ignored. Thus, relative speeds between the polishing plates and the carrier are controlled on the basis of a prescribed formula considering the rotation of the carrier so as to reduce a load applied to the carrier (see Japanese Patent Gazette No. 5-123962).

However, in the method disclosed in the Japanese gazette, the work cannot be always precisely polished, in spite of the complex formula, due to various factors. Namely, the load applied to the carrier is influenced by not only the rotational speeds of the polishing plates, an orbital speed and the rotational speed of the carrier but also conditions of the polishing plates (polishing pads), amount of feeding abrasive liquid (slurry), etc. The conventional method does not consider those factors.

SUMMARY OF THE INVENTION

The present invention was conceived to solve the above described problems.

An object of the present invention is to provide a method of precisely polishing a work, in which torque of a sun gear and an internal gear are kept constant, various influence factors are absorbed and a load applied to a carrier is reduced and maintained.

To achieve the object, the present invention has following constitutions.

Namely, a method of polishing a work is performed in an polishing apparatus comprising: a sun gear; an internal gear; a carrier for holding the work, the carrier engaging with the sun gear and the internal gear; an upper polishing plate; and a lower polishing plate, and the work is polished by the upper polishing plate and the lower polishing plate, which are rotated in the opposite directions, with supplying abrading liquid. The method comprises the steps of:

changing a rotational speed of at least one of the sun gear, the internal gear, the upper polishing plate and the lower polishing plate;

measuring rotation torque of a driving motor of at least one of the sun gear and the internal gear;

detecting the minimum rotation torque measured in the measuring step; and adjusting the rotational speed of at least one of the sun gear, the internal gear, the upper polishing plate and the lower polishing plate so as to make the rotation torque thereof equal to the minimum rotation torque or running rotation torque, the running torque being greater by a prescribed value than the minimum rotation torque.

In the method, the sun gear, the internal gear, the upper polishing plate and the lower polishing plate may be rotated at predetermined standard rotational speeds in the detecting step, and the rotation torque of at least one of the sun gear, the internal gear, the upper polishing plate and the lower polishing plate may be measured with changing the rotational speed thereof more than once around the standard rotational speed thereof.

In the method, the standard rotational speeds may be defined so as to make a relative difference between a rotation number of the upper polishing plate and a number of orbital motion of the carrier and a relative difference between a rotation number of the lower polishing plate and the number of orbital motion of the carrier equal and orient in the opposite directions.

In the method, the running rotation torque may be set as the rotation torque so as to always apply contact pressure from the sun gear and the internal gear to the carrier without forming backlash between the sun gear, the internal gear and the carrier.

In the method, the rotational speeds of the sun gear and the internal gear may be changed while polishing the work. The rotational speeds of the upper polishing plate and the lower polishing plate may be changed while polishing the work. Further, an amount of feeding the abrasive liquid from the upper polishing plate side and/or the lower polishing plate side may be changed while polishing the work, and the rotational torque of the both driving motors may be made equal to the running rotation torque.

In the method of the present invention, the rotation torque of the sun gear or the internal gear are measured, the load applied to the carrier is measured, and the work is polished with the minimum rotation torque. Therefore, the polish can be performed by considering the rotation of the carrier and polish of the polishing plates, so that the work can be precisely polished without badly influencing the work.

BRIEF DESCRIPTION OF THE DRAWINGS

Embodiments of the present invention will now be described by way of examples and with reference to the accompanying drawings, in which.

DETAILED DESCRIPTION OF THE EMBODIMENTS

Preferred embodiments of the present invention will now be described in detail with reference to the accompanying drawings.

Figure 1:
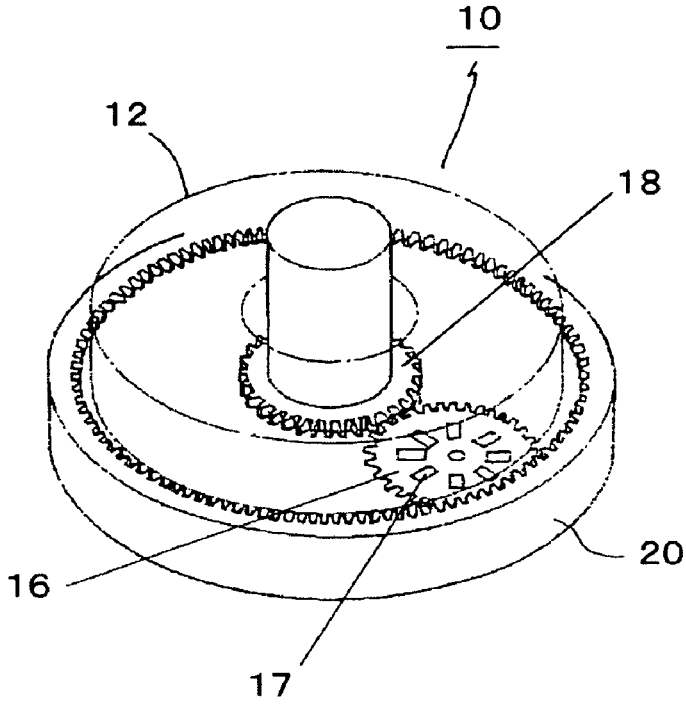
FIG. 1 is a schematic view of a polishing apparatus for polishing both surfaces of works.
Figure 2:
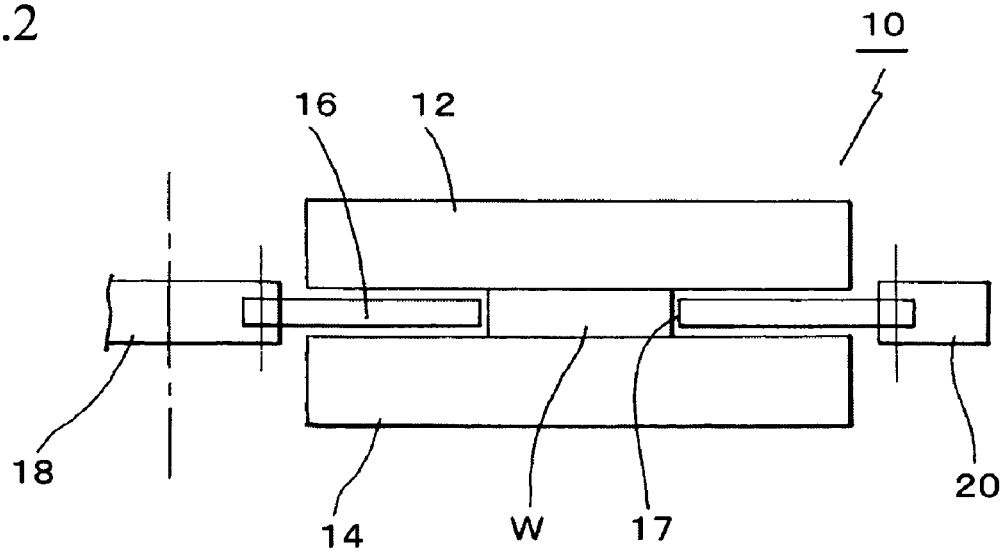
FIG. 2 is a sectional explanation view of the polishing apparatus.
Figure 3:
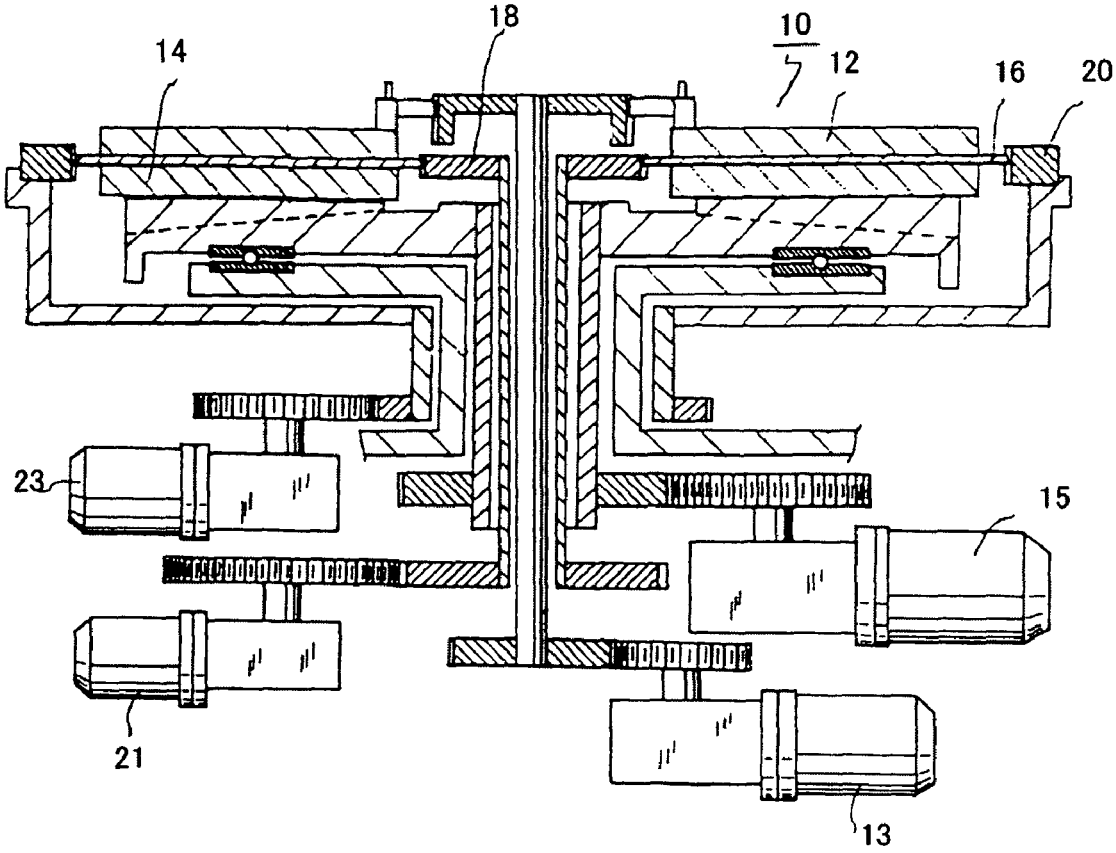
FIG. 3 is an explanation view of the polishing apparatus.

FIG. 1 is a schematic view of a known polishing apparatus 10 for polishing both surfaces of works, FIG. 2 is a sectional explanation view of the polishing apparatus and FIG. 3 is an explanation view of the polishing apparatus.

An upper polishing plate 12, which acts as an upper lapping plate, and a lower polishing plate 14, which acts as a lower lapping plate, are mutually faced and respectively driven by driving motors 13 and 15, e.g., servo motors. The upper polishing plate 12 and the lower polishing plate 14 are rotated in the opposite directions. The upper polishing plate 12 is vertically moved by a vertical driving mechanism (not shown), e.g., cylinder unit.

To polish works, polishing pads are respectively adhered on polishing faces of the polishing plates 12 and 14, which are mutually faced.

A carrier 16 is provided between the polishing plates 12 and 14 and engaged with a sun gear 18, which is rotatably provided at the center of the apparatus 10, and an internal gear 20, which is rotatably provided an outer part of the apparatus 10. The carrier 16 is rotated about its own axis and orbited around the sun gear 18. The carrier 16 has a plurality of work holes 17, in each of which a work W, e.g., silicon wafer, is held, so as to convey the works W.

Therefore, the carrier 16 holding the works W is engaged with the sun gear 18 and the internal gear 20, rotated about its own axis, and orbited around the sun gear 18. Further, upper faces and lower faces of the works W contact the polishing faces of the polishing plates 12 and 14, so that the both faces of the works W can be polished. Note that, abrading liquid, e.g., slurry, is fed to the polishing plates 12 and 14 from a feeding unit (not shown) while polishing the works W.

The sun gear 18 and the internal gear 20 are respectively rotated by driving motors 21 and 23, e.g., servo motors. Rotational speeds (angular speeds) of the driving motors can be controlled, and loads (torque) thereof can be detected by a sequencer.

In the method of the present invention, the works W are polished with changing a rotational speed of at least one of the sun gear 18, the internal gear 20, the upper polishing plate 12 and the lower polishing plate 14 a plurality of times. Rotation torque of the driving motor of at least one of the sun gear 18 and the internal gear 20 is measured, and the minimum rotation torque measured is detected.

Note that, the minimum rotation torque means a local minimum value of the measured rotation torque, from which the rotation torque is increased and which is varied by increasing and reducing the rotational speed. To gain the local minimum value, the rotational speed is changed a plurality of times. The local minimum value is relative rotation torque, which is measured when the rotational speed is changed as previously designed, and it need not be an absolute minimum value, which is gained by linearly varying the rotational speed.

To easily detect the local minimum value, the sun gear 18, the internal gear 20 and the polishing plates 12 and 14 are rotated at predetermined standard rotational speeds (angular speeds) at the beginning of the polishing process.

For example, the standard rotational speed are defined so as to make a relative difference between a rotation number of the upper polishing plate 12 and a number of orbital motion of the carrier 16 and a relative difference between a rotation number of the lower polishing plate 14 and the number of orbital motion of the carrier 16 equal and orient in the opposite directions. For example, when the upper polishing plate 12 is rotated in the clockwise direction, the carrier 16 is orbited in the counterclockwise direction and the lower polishing plate 14 is rotated in the counterclockwise direction, the ratio of the rotation and orbit numbers of the upper polishing plate 12, the carrier 16 and the lower polishing plate 14 is designed as 1:1:3. In this case, the rotation of the carrier 16, conditions of the polishing pads, etc. are not considered, but a frictional force between the upper polishing plate 12 and an upper face of the carrier 16 and a frictional force between the lower polishing plate 14 and a lower face of the carrier 16 can be made equal and oriented in the opposite directions. Therefore, conditions for generating the minimum rotation torque can be easily found.

In the present embodiment, while polishing the works W, the rotational speed of at least one of the sun gear 20, the internal gear 20, the upper polishing plate 12 and the lower polishing plate 14 is adjusted so as to make the rotation torque thereof equal to the minimum rotation torque or running rotation torque, the running torque being greater by a prescribed value than the minimum rotation torque.

A load applied to the carrier 16 is influenced by the rotational speeds and the rotational directions of the polishing plates 12 and 14, the rotational speeds of the sun gear 18 and the internal gear 20, the rotation of the carrier 16, conditions of the polishing pads, amount of feeding the slurry, rotation of the works W, etc. But, in the present embodiment, the rotation torque of the sun gear 18 or the internal gear 20 are measured, the load applied to the carrier 16 is measured, and the works W are polished with the minimum rotation torque. So the polish can be performed with substantially considering the rotation of the carrier 16 and polish of the polishing plates. Therefore, the works W can be precisely polished without deforming the carrier 16 and badly influencing the works.

Note that, the works W are suitably polished when the load applied to the carrier 16 is minimized. The load applied to the carrier 16 is minimized when the rotation torque of the sun gear 18 and the internal gear 20 are minimized. However, if the frictional forces generated on the upper and the lower faces of the carrier 16 are balanced, the rotation torque becomes zero. If the rotation torque is zero, backlashes are formed between the sun gear 18, the internal gear 20 and the gear of the carrier 16. By the backlashes, the gears are damaged or broken and the carrier 16 jounces, so that polishing accuracy must be lowered.

Thus, the rotational speeds of the sun gear 18, the internal gear 20 and the polishing plates 12 and 14 are adjusted so as to set the running rotation torque, the running torque being greater by the prescribed value than the minimum rotation torque, as the rotation torque. Therefore, contact pressure can be always applied from the sun gear 18 and the internal gear 20 to the carrier 16 without forming the backlashes between the gears.

In the polishing step of the present embodiment, the rotation torque of the sun gear 18 and the internal gear 20 are directly influenced by changing the rotational speeds thereof, so the rotation torque thereof can be easily adjusted. Note that, the rotational speeds of the polishing plates 12 and 14 may be changed.

Further, in the polishing step, the running rotation torque may be controlled by changing an amount of feeding the slurry from the upper polishing plate side and/or the lower polishing plate side.

The invention may be embodied in other specific forms without departing from the spirit of essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A method of polishing a work in a polishing apparatus, comprising: a sun gear; an internal gear; a carrier for holding the work, said carrier engaging with said sun gear and said internal gear; an upper polishing plate; and a lower polishing plate, wherein the work is polished by said upper polishing plate and said lower polishing plate, which are rotated in the opposite directions, with supplying abrading liquid, said method comprising:

polishing the work held in the carrier for an initial first period by:

changing a rotational speed of at least one of said sun gear, said internal gear, said upper polishing plate and said lower polishing plate a plurality of times while polishing the work;

measuring rotation torque of a driving motor of at least one of said sun gear and said internal gear at each of the changed rotational speeds; and detecting a minimum rotation torque of the measured rotational torques while said sun gear, said internal gear, said upper polishing plate and said lower polishing plate are rotated at predetermined standard rotational speeds, and while the rotation torque of at least one of said sun gear, said internal gear, said upper polishing plate and said lower polishing plate is measured by changing the rotational speed thereof more than once with respect to the standard rotational speeds thereof; and polishing the work held in the carrier for a main second period following said initial first period by:

adjusting the rotational speed of at least one of said sun gear, said internal gear, said upper polishing plate and said lower polishing plate so as to make the rotation torque thereof equal to a running rotation torque, the running rotation torque being greater by a prescribed value than the minimum rotation torque, whereby a load applied to said carrier is minimized while polishing the work.

2. The method according to claim 1, wherein the standard rotational speeds are defined so as to make a relative difference between a rotation number of said upper polishing plate and a number of an orbital motion of said carrier, and a relative difference between a rotation number of said lower polishing plate and the number of the orbital motion of said carrier, to be equal and to be oriented in opposite directions.

3. The method according to claim 1, wherein the running rotation torque is set as the rotation torque so as to always apply contact pressure from said sun gear and said internal gear to said carrier without forming backlash between said sun gear, said internal gear and said carrier.

4. The method according to claim 1, wherein the rotational speeds of said sun gear and said internal gear are changed while polishing the work.

5. The method according to claim 1, wherein the rotational speeds of said upper polishing plate and said lower polishing plate are changed while polishing the work.

6. The method according to claim 1, wherein an amount of the abrading liquid fed from the upper polishing plate side and/or the lower polishing plate side is changed while polishing the work, and the rotational torque of each of two driving motors is made equal to the running rotation torque.

7. A method of polishing a work in a polishing apparatus, comprising:

a sun gear; an internal gear; a carrier for holding the work, said carrier engaging with said sun gear and said internal gear; an upper polishing plate; and a lower polishing plate, wherein the work is polished by said upper polishing plate and said lower polishing plate, which are rotated in the opposite directions, said method comprising:

polishing the work held in the carrier for an initial first period by:

changing a rotational speed of at least one of said sun gear, said internal gear, said upper polishing plate and said lower polishing plate a plurality of times, around predetermined standard rotational speeds while polishing the work;

measuring rotation torque of a driving motor of at least one of said sun gear and said internal gear at each of the changed rotational speeds; and detecting a minimum rotation torque of the measured rotational torques while said sun gear, said internal gear, said upper polishing plate and said lower polishing plate are rotated at predetermined standard rotational speeds, and while the rotation torque of at least one of said sun gear, said internal gear, said upper polishing plate and said lower polishing plate is measured by changing the rotational speed thereof more than once with respect to the standard rotational speeds thereof; and polishing the work held in the carrier for a main second period following said initial first period by:

adjusting the rotational speed of at least one of said sun gear, said internal gear, said upper polishing plate and said lower polishing plate so as to make the rotation torque thereof equal to a running rotation torque, the running rotation torque being greater by a prescribed value than the minimum rotation torque, whereby a load applied to said carrier is minimized while polishing the work.

8. The method according to claim 7, wherein the standard rotational speeds are defined so as to make a relative difference between a rotation number of said upper polishing plate and a number of an orbital motion of said carrier, and a relative difference between a rotation number of said lower polishing plate and the number of the orbital motion of said carrier, to be equal and to be oriented in opposite directions.

* * * * *